US005085405A

United States Patent [19]

Vetter

[11] Patent Number: 5,085,405

[45] Date of Patent: Feb. 4, 1992

[54] HOISTING CUSHION WITH TWO REINFORCED WALLS

[76] Inventor: Manfred Vetter, Burg Langendorf, D-5352 Zülpich-Langendorf, Fed. Rep. of Germany

[21] Appl. No.: 626,970

[22] Filed: Dec. 13, 1990

[30] Foreign Application Priority Data

Dec. 14, 1989 [DE] Fed. Rep. of Germany ... 8914694[U]

[51] Int. Cl.[5] ..... B66F 3/24

[52] U.S. Cl. ..... 254/93 HP

[58] Field of Search ..... 254/93 HP; 92/34, 35; 29/454; 428/12

[56] References Cited

U.S. PATENT DOCUMENTS 2,714,011 7/1955 Albee ..... 254/93 HP 3,982,731 9/1976 Tezuka ..... 254/93 HP

FOREIGN PATENT DOCUMENTS 3426966 1/1986 Fed. Rep. of Germany ... 254/93 HP

*Primary Examiner*—Robert C. Watson

*Attorney, Agent, or Firm*—K. S. Cornaby

[57] ABSTRACT

The invention pertains to a hoisting cushion with two reinforced walls that are manufactured of rubber or of a rubber-like material. The walls of the press (a) are linked around the full extent of the edges and define an hermetically sealed inner space that is accessible via a nipple, and (b) reveal on their external surface a fairing which is sited outside of the reinforcing.

12 Claims, 2 Drawing Sheets

HOISTING CUSHION WITH TWO REINFORCED WALLS

BACKGROUND OF THE INVENTION

The invention pertains to a hoisting cushion or pad with two reinforced walls that are manufactured of rubber or of a rubber-like material. The walls of the cushion (a) are linked around the full extent of the edges and define an hermetically sealed inner space that is accessible via a nipple, and (b) reveal on their external surface fairing which is sited outside of the reinforcing.

In hoisting cushions of the type, to which reference is made in the introductory remarks and to which German Patent 75 38 274 or respectively the parallel U.S. Pat. No. 4,067,544 refer, no fairing of the external surface of both walls is evident. In contrast, however, the cushions that are constructed in accord with the principles of these publications do reveal fairings on the external surfaces of their walls. Hoisting cushions are also disclosed in U.S. Pat. Nos. 4,036,472; 4,143,854 and 4,104,425. Hoisting cushions in the form of compressed or compact cushions are familiar for example from U.S. Pat. No. 4,880,035. Here, too, the hoisting cushions that are in practical use and available on the market reveal some fairing on one outside surface of at least one wall, in general on that wall which faces away from the leak.

A fairing in the form of rubber ribs is familiar. This fairing derives from ribs that are 20 mm along their edge, 2 mm wide and 2 mm high and that extend regularly over the outer surface of the walls. This fairing-contouring prevents the cushion from slipping especially on surfaces that are smooth, soiled or slippery. The fairing creates also a surface that has an aesthetically pleasing and technically effective exterior surface structure.

A disadvantage of the fairing that is already familiar is, however, that dirt can collect in the inner corners between the points where the rubber ribs intersect. Generally speaking, this dirt cannot easily be removed, and it is in the way when the hoisting cushion is subsequently used.

A further disadvantage of the fairing that is already familiar is the fact that the ribs do not allow any cross drainage. When working on wet or oil-coated surfaces on which the cushion must be placed, this can lead to problems.

The invention addresses this point. It is the purpose of this invention to avoid the disadvantages of the hoisting cushions of the kind to which reference is made in the introductory remarks and to develop the fairing in such a way that the surface of the cushion can be more easily cleaned while tending to provide opportunity for dirt to collect. The fairing should also be aesthetically satisfying and suitable for practical use.

Proceeding from the type of hoisting cushion to which reference is made in the introductory remarks this problem is solved by having the fairing formed from circular disc-shaped protrusions that are arranged regularly over the surface. These protrusions project outwardly from the outer surface of the walls, this surface being otherwise flat. They have a diameter of 10 to 30 mm, and they project 0.2 to 0.5 mm beyond the outer surface of the wall. They are so arranged that the distance to the nearest adjacent protrusion is smaller than the diameter of the protrusions.

A fairing configuration of this type has no ideal spot, especially no inner corners, in which dirt can collect.

The protrusions form, in contrast to the familiar fairing pattern, a relatively large surface area of their own, and this ensures that the cushion sits snugly on objects on which it is set. The fairing configuration that is in accord with the invention effectively prevents the cushion from slipping. Practical tests were able to demonstrate this. In practice, the fairing configuration can be effectively achieved by incorporating in the mold for the cushions of the type noted in the introductory remarks, the protrusions as depressions. The protrusions are then formed during the process of vulcanization, and additional steps in the production process that are intended to manufacture the protrusions are not required.

The protrusions should have a diameter of at least 10 mm in order to provide a surface of their own that is sufficiently large. Smaller protrusions have, in practical tests, proven to be unsatisfactory. However, even protrusions with a diameter in excess of 30 mm have resulted in poor test values with respect to the grip of the cushion on some surfaces, for example oily as well as soiled surfaces. The stated dimension defining the height of the protrusions has also proven effective in practical use. Protrusions which are smaller than 0.2 mm result in practical terms in no positive grip whatsoever, and protrusions which exceed 5 mm in height tend in practice to be damaged.

This description of the protrusions as circular disc-shaped is to be understood here as indicating that they have their own plane and a surface that runs parallel to the outside surface of the wall. It is to be further understood as indicating that they are limited by an outer jacket with a surface that is circular and that has essentially the shape of a cylinder or a blunt cone. The transition between the surface of the protrusion and the outer surface of the jacket can be rounded as can the transition between the jacket surface and the surface of the wall. When formed as a blunt cone, the angle of the cone is below 40°, and the cone narrows proceeding from the surface of the wall as it moves towards the surface of the protrusion. Ideally, the curvatures are so constructed that their radius does not exceed 3 mm.

In the preferred type of the invention, the protrusions are linked integrally with the material of the wall. They are formed in the process of vulcanization under heat that manufactures the walls. In a further preferred development of the invention, the actual surface area of the protrusions totals at least 40%, and preferably 50%, of the total surface area of the outer side of the cushion. In contrast to cushions manufactured according to the present state of the art, cushions manufactured in accordance with this invention have a considerably greater surface area that is covered by these protrusions. For in cushions presently available, approximately 20% only of the total surface is taken up by the rib-shaped fairing. The new development therefore leads to lower tensions/pressures and to less deformation in the walls of the cushions when the inflated cushion is subjected to load.

Finally, it has proven advantageous to arrange the center points of the circular, disc-shaped protrusions on straight lines that run parallel to one another, the distance between the center points of adjacent protrusions on the same straight line being less than four times the radius of the protrusions and the protrusions on adjacent straight lines being arranged in a juxtaposed manner so that they face towards vacant spaces. The advantages of such an arrangement are especially evident when the cushion is employed on a line-shaped support, for example, along an edge, for when employed in such a situation, you can be sure that some of the protrusions will be resting along the edge. It will never happen that the edge will be resting between protrusions.

Further advantages and characteristics of the invention are evident from the remaining claims filed and from the following description of types of the invention, it being understood that the types that are described do not limit in any way the claims that are sought. These types are described in greater detail with reference to the drawings.

THE DRAWINGS

FIG. 1—a view from above of a hoisting cushion, the cushion not being inflated.

FIG. 2—detail II from FIG. 1, which detail is enlarged.

FIG. 3—a cross-section along the line III—III in FIG. 2.

FIG. 4—a cross-section that is similar to the cross-section shown in FIG. 3 but that is from a different version of the invention.

FIG. 5—a cross-section that is similar to the cross-section shown in FIG. 3 but that is from yet another version of the invention.

FIG. 6—a representation in accord with FIG. 2 but showing a different surface ordering of the protrusions.

DETAILED DESCRIPTION OF THE DRAWING

Figure 1:
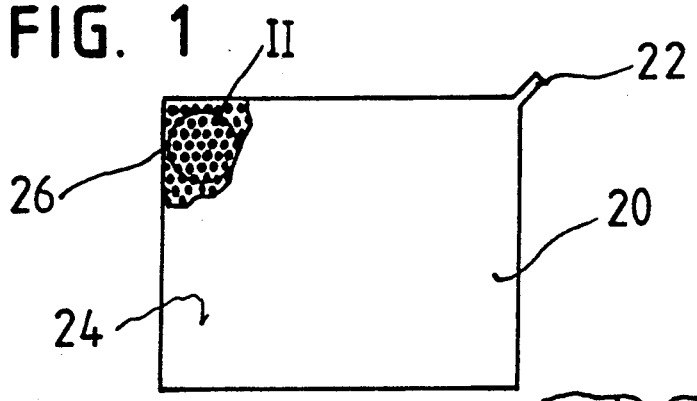

A hoisting cushion manufactured in accord with FIG. 1 consists of two identical walls 20 made of rubber or a rubber-like material. Of these two walls, only one is to be seen in the drawing. These two walls are linked around their edge over the total extent of the edge. This can be accomplished in one piece by, for example, folding back one side of one section which extends into both walls, or it can be accomplished by gluing, vulcanization, etc. Both the walls 20 define an hermetically sealed inner space that is accessible via a nipple 22.

The external surface 24 of the wall 20 is formed of a fairing conformation in the shape of circular, disc-shaped protrusions 26 that are deliberately arranged in a pattern. These protrusions are identical and form a surface area 28 that is flat and that runs parallel to the undisturbed surface 24. They have also an annular jacket surface 30. In the three illustrated versions of the invention this latter surface is essentially cylindrical in (1) the version in accord with FIGS. 1 to 3, in (2) in the version in accord with FIG. 5 and (3) in the version in accord with FIG. 6, and in the version that is in accord with FIG. 4 it is essentially in the shape of a blunt cone that tapers towards the outside.

Figure 2:
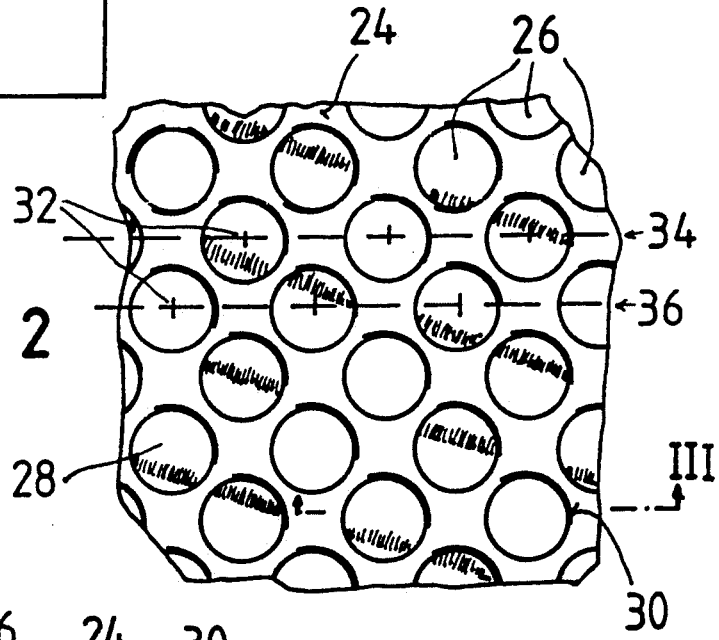
Figure 3:
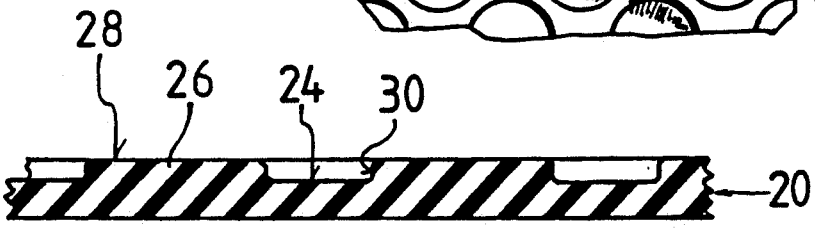

In a version constructed in accord with the FIGS. 1 to 3 the diameter of the protrusions is 25 mm, and they extend 3 mm above the undisturbed surface 24. In the region of the transition between the surface 24 and the jacket surface 30 as well as in the region between the jacket surface 30 and the surface 28 the contour is rounded, the radius of the contour being 2 mm. For the rest the surface of the jacket 30 is cylindrical.

The protrusions 26 are each integral components of the pertinent wall 2 and arranged regularly over the whole surface. The actual pattern of arrangement is evident from FIG. 2. As shown in the drawing, the center points 32 of the individual protrusions 26 lie along parallel straight lines—in FIG. 2, 34 and 36 designate straight lines, these lines being adjacent. The protrusions that are arranged along straight line 34 are so arranged counter to the protrusions along line 36 that they face gaps. In other words: the protrusions 26 of adjacent lines 34, 36 are counter-set by half the distance between the center points.

Figure 4:
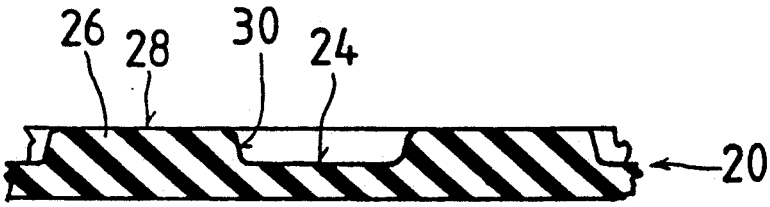

In the version manufactured in accord with FIG. 4, the jacket surface 30 on the mantel of a jacket is set at an angle of 30°. The protrusions 26 are 5 mm high, each transition between the surface of the jacket 30 and both the surfaces 24 and 28 being circular.

Figure 5:
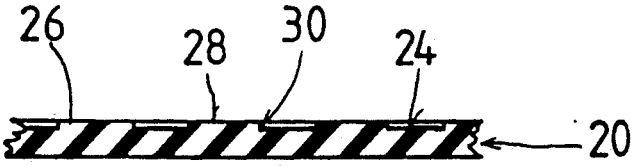

FIG. 5 shows relatively flat protrusions 26. They protrude 0.5 mm beyond the surface 24 and have a diameter of 10 mm.

Figure 6:
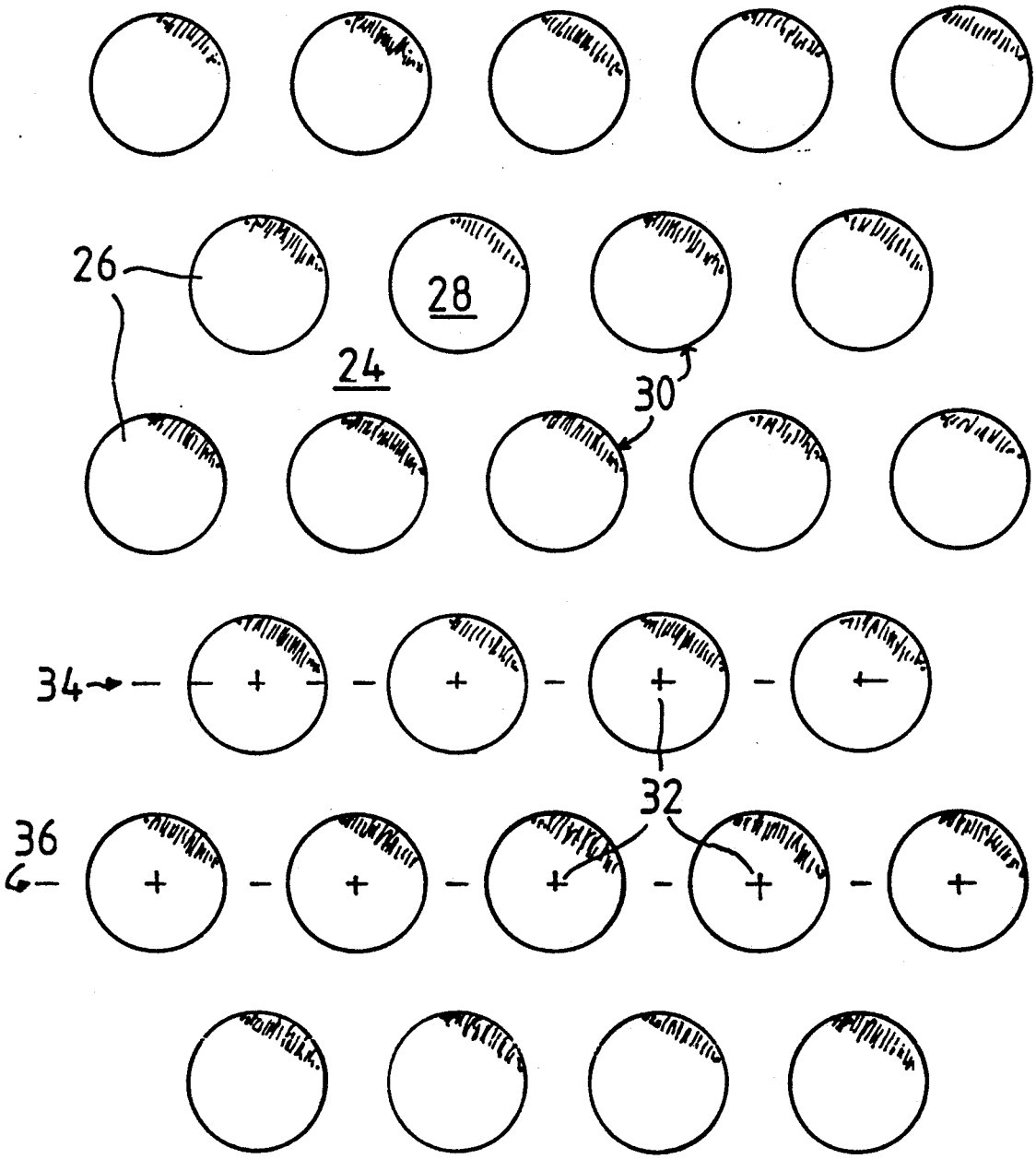

FIG. 6 shows a different arrangement of the protrusions 26. In this arrangement, six protrusions are arranged around each protrusion 26 in such a way that the middle points of the surrounding protrusions 32 lie on a circle around the middle point of the surface area of the protrusion under view. At the same time, the six adjacent protrusions are arranged evenly. In other words: the six adjacent neighbors are sited on the corner points of a six-sided figure, the protrusion 26 that is under view being sited on the center point of this six-sided figure. The protrusions have a diameter of 20 mm. Their arrangement might also be described thus: their center points lie on straight lines 34, 36 that are spaced 30 mm apart. The distance between two protrusions 26 on one and the same straight line 34, or res. 36 is 10 mm.

I claim:

1. A hoisting cushion with two reinforced walls that is manufactured of one of a rubber material and a rubber-like material wherein the two walls of the cushion are lined at their margins and define an hermetically sealed inner space that is accessible via a nipple and have a contoured external surface that is sited outside of the reinforcing and exhibits circular, disc-shaped protrusions that are arranged in a pattern, and the protrusions protrude outwardly beyond the otherwise flat, protrusion-free surface of the walls, and have a diameter of 10 to 30 mm and protrude 0.2 to 5 mm beyond the protrusion-free surface of the walls, and which protrusions are arranged in such a way that the distance to the next adjacent protrusion is less than the diameter of the protrusions, and the surface area of the protrusions amounts to at least 30% of the total external surface area.

2. A hoisting cushion as set forth in claim 1, wherein the protrusions are in the shape of a blunt cone.

3. A hoisting cushion as set forth in claim 1, wherein the protrusions are in the shape of a cylinder.

4. A hoisting cushion as set forth in claim 1, wherein the region of transition between the protrusions and the protrusion-free surface of the wall is rounded.

5. A hoisting cushion as set forth in claim 1, wherein the region of transition between the protrusions and the protrusion-free surface of the wall has a radius that is less than 3 mm.

6. A hoisting cushion as set forth in claim 1, wherein the protrusions have side faces and a protrusion surface, and the region of transition between said side faces and the protrusion surface is rounded.

7. A hoisting cushion as set forth in claim 1, wherein the protrusions have side faces and a protrusion surface, and the region of transition between said side faces and the protrusion surface has a radius that is less than 3 mm.

8. A hoisting cushion as set forth in claim 1, wherein the protrusions are linked integrally with the material of the wall.

9. A hoisting cushion as set forth in claim 1, wherein the center points of the protrusions are arranged along straight lines that run parallel to one another, and the distance between the center points of adjacent protrusions on one and the same straight line is less than four times the radius of the protrusions, and wherein the protrusions on adjacent parallel lines are set counter to one another in such a way that they face gaps.

10. A hoisting cushion as set forth in claim 1, wherein the free spaces between the protrusions on the external surface of the wall are smaller in size than the surface area of one protrusion.

11. A hoisting cushion as set forth in claim 1, wherein the protrusions are identical in construction.

12. A hoisting cushion as set forth in claim 1, wherein the surface area of the protrusions amounts to at least 40% of the total external surface area.

* * * * *